US009145225B2

(12) United States Patent
Valot et al.

(10) Patent No.: US 9,145,225 B2
(45) Date of Patent: Sep. 29, 2015

(54) TRAY FOR TRANSPORTING AND DISPLAYING ITEMS SUCH AS YOGURT CONTAINERS

(75) Inventors: Denis Valot, Sassenay (FR); Jean-Yves Malnoy, Baudrieres (FR); Frederic Catherine, Saint Cyr (FR); Damien Tartre, L'Abergement Sainte Colombe (FR)

(73) Assignees: SOCIETE NORMANDE DE CARTON ONDULE, Chalon sur Saone (FR); PAPETERIES D'ESPALY, Saint Marcel (FR); EMBALLAGES LAURENT SAS, Chalon sur Saone (FR); SOCIETE MEDITERRANEENNE D'EMBALLAGES, Arles (FR)

( * ) Notice: Subject to any disclaimer, the term of this patent is extended or adjusted under 35 U.S.C. 154(b) by 159 days.

(21) Appl. No.: 13/565,918

(22) Filed: Aug. 3, 2012

(65) Prior Publication Data

US 2013/0037439 A1 Feb. 14, 2013

Related U.S. Application Data

(63) Continuation of application No. PCT/FR2011/050217, filed on Feb. 3, 2011.

(30) Foreign Application Priority Data

Feb. 4, 2010 (FR) ..... 10 50771

(51) Int. Cl.
*B65D 21/032* (2006.01)
*B65D 5/28* (2006.01)
*B65D 5/00* (2006.01)

(52) U.S. Cl.
CPC ..... *B65D 5/003* (2013.01)

(58) Field of Classification Search
CPC .. B65D 5/0045; B65D 5/2033; B65D 5/0035; B65D 5/003
USPC ..... 206/557, 503, 509, 512; 229/915, 113, 229/116, 186, 109, 114, 190, 918
See application file for complete search history.

(56) References Cited

U.S. PATENT DOCUMENTS

| | | | | |
|---|---|---|---|---|
| 1,911,952 | A | 5/1933 | Halladay | |
| 2,713,962 | A | 7/1955 | Camp et al. | |
| 2,822,119 | A * | 2/1958 | Van Dyke | 229/168 |
| 3,462,065 | A | 8/1969 | Asman | |
| 4,533,065 | A | 8/1985 | Chazal et al. | |
| 5,028,000 | A | 7/1991 | Chabot et al. | |
| 5,890,649 | A | 4/1999 | Baxter | |
| 5,913,474 | A * | 6/1999 | Chu | 229/167 |

(Continued)

FOREIGN PATENT DOCUMENTS

| | | |
|---|---|---|
| BE | 1012844 A6 | 4/2001 |
| EP | 337840 | 10/1989 |

(Continued)

*Primary Examiner* — Luan K Bui
*Assistant Examiner* — Chun Cheung
(74) *Attorney, Agent, or Firm* — Thomas W. Ryan, III

(57) ABSTRACT

The invention relates to a tray for transporting and displaying items such as yogurt containers. The tray is of the type comprising a bottom wall (1) and side walls (3 to 5) hingedly connected to the bottom wall and folded upwards at a substantially right angle, and at least one stacking lug (7) extending upwards away from the plane of the side wall, the tray being obtained by folding from a rectangular blank of corrugated cardboard. The tray is characterized in that the blank has a rectangular outline and in that the parts forming the lug (7) are included in said outline. The invention can be used to make trays for transporting yogurt containers.

4 Claims, 2 Drawing Sheets

(56) References Cited

U.S. PATENT DOCUMENTS

| | | | | |
|---|---|---|---|---|
| 6,158,652 | A | 12/2000 | Ruiz et al. | |
| 6,508,395 | B2 * | 1/2003 | McLeod | 229/174 |
| 7,740,164 | B2 * | 6/2010 | McClure | 229/190 |
| 2007/0090172 | A1 * | 4/2007 | Lyon et al. | 229/5.84 |
| 2013/0056526 | A1 | 3/2013 | Valot et al. | |

FOREIGN PATENT DOCUMENTS

| | | |
|---|---|---|
| EP | 1243515 | 9/2002 |
| FR | 2329523 | 5/1977 |
| FR | 2761340 | 10/1998 |
| FR | 2815017 | 4/2002 |
| FR | 2837465 | 9/2003 |
| FR | 2885881 | 11/2006 |
| FR | 2903079 | 1/2008 |
| FR | 2905937 | 3/2008 |
| FR | 2932461 | 12/2009 |
| JP | 9207940 | 8/1997 |
| WO | 2006039473 | 4/2006 |
| WO | 2011095742 | 8/2011 |
| WO | 2012010756 | 1/2012 |

* cited by examiner

TRAY FOR TRANSPORTING AND DISPLAYING ITEMS SUCH AS YOGURT CONTAINERS

The invention relates to a tray for transporting and displaying items such as yogurt containers, of the type comprising a bottom wall and side walls hingedly connected to the bottom wall and folded upwards at a substantially right angle, and at least one stacking lug extending upwards in the extension of the plane of a side wall, the tray being obtained by folding from a single rectangular blank of corrugated cardboard.

Trays of this type having a general rectangular shape and comprising two lugs on each of the two shortest opposing walls are already known.

These trays have the drawback that the four lugs protrude beyond the rectangular outline of the initial lug, which results in the loss, for example, of 5% of corrugated cardboard material.

The objective of the invention is to remedy this drawback.

To achieve this objective, a tray according to the invention is characterized in that it has a rectangular outline and in that the parts forming the lugs are included in this outline.

According to one feature of the invention, the tray is characterized in that the lug is formed on a side flap of a main flap forming a side wall which is hingedly connected to the main flap by an interface area such that it pivots in a position perpendicular to the main flap, and for attaching to the adjacent straightened wall flap, in that the cut inside edge of the side flap is inclined with respect to the fold line of the main flap such that the height of the side flap is greater at its end than the height in the interface area, and in that this interface area comprises a fold line device which ensures that this edge is parallel to the bottom wall when the side flap is in its abovementioned attachment position.

According to another feature of the invention, the tray is characterized in that the interface area is in the shape of a triangle the apex of which is located at the upper free edge of the flaps and the base of which is cut in the blank and adjacent to the bottom wall, and in that the lateral sides of the triangle constitute fold lines.

According to yet another feature of the invention, the tray is characterized in that the bottom wall is cut and rounded off in the abovementioned interface area.

According to yet another feature of the invention, the tray is characterized in that, in the blank, the upper outside edge of the side flap comprises at its end a part in which this edge is in alignment with the upper edge of the main flap, whereas the remaining part of the upper edge is inclined and parallel to the lower edge of the flap, and in that, when the flap is in its abovementioned raised attachment position, the edge part is substantially in alignment with the outside edge of the straightened wall flaps, the upper edge portion constituting the stacking lug.

According to yet another feature of the invention, the tray is characterized in that the side flap comprises at least one notch cut in the lower edge which is disposed below the portion of the lug and forms, with a notch in the adjacent side wall flap and in the peripheral portion of the bottom wall, when the tray is assembled, a receiving space for the lug of a lower tray in a stack of trays.

According to yet another feature of the invention, the tray is characterized in that the side flaps are associated with main flaps which constitute the longest walls of the tray.

The invention will be more readily understood, and other objectives, features, details and advantages thereof will become more clearly evident in the explanatory description that follows, in which reference is made to the enclosed drawings provided solely for the sake of example and illustrating an embodiment of the invention, wherein.

Figure 3:
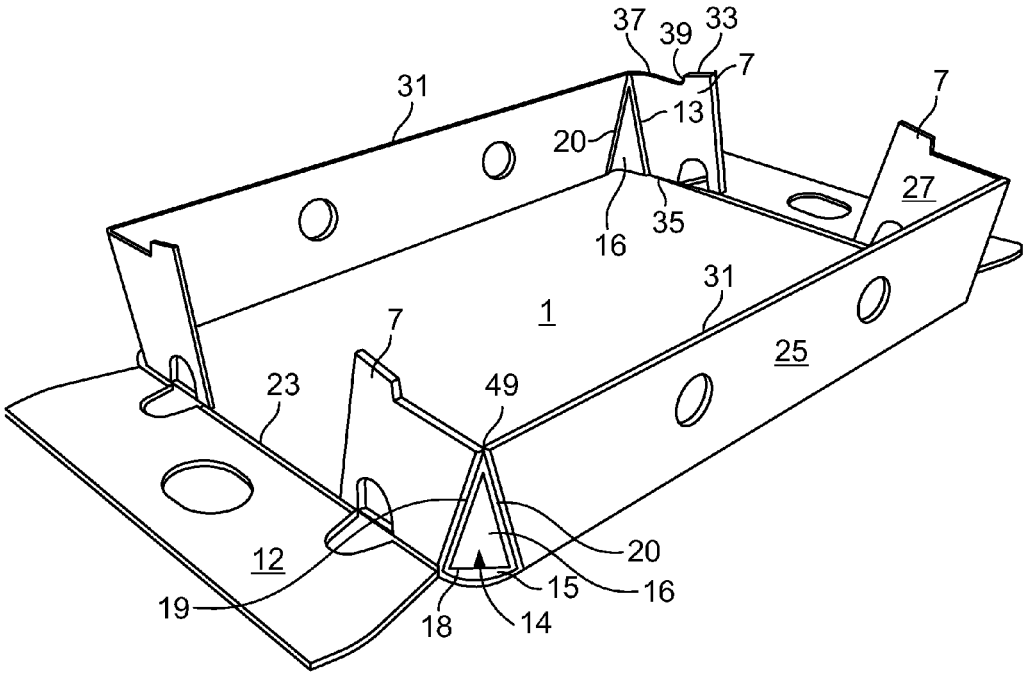
Figure 4:
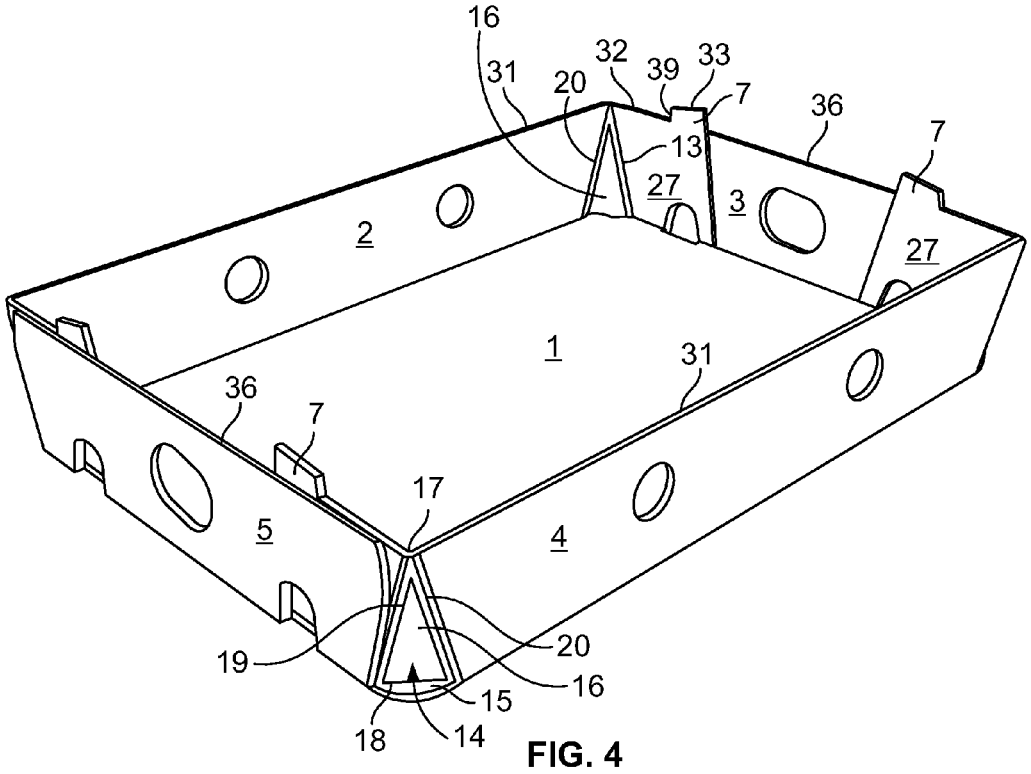
FIG. 4 is a perspective view of a tray according to the invention in the finished state.

With reference to FIG. 3, a tray according to the invention essentially comprises a bottom wall 1 having a substantially rectangular shape and four side walls 2, 3, 4 and 5 which extend vertically starting from the bottom wall 1, i.e., two parallel opposed side walls 2 and 4 of greater length and two parallel opposed walls of lesser length 3 and 5. The tray is formed by folding a blank of corrugated cardboard having a rectangular shape with appropriate lines for cutting and folding.

Each of the two shorter walls 3, 5 comprises two stacking lugs 7 arranged symmetrically with respect to the median longitudinal axis of the tray and, substantially vertically below each lug 7, an opening 9 enabling the receiving of the stacking lug 7 of the lower tray in the stack formed in this way when several trays are stacked.

Figure 2:
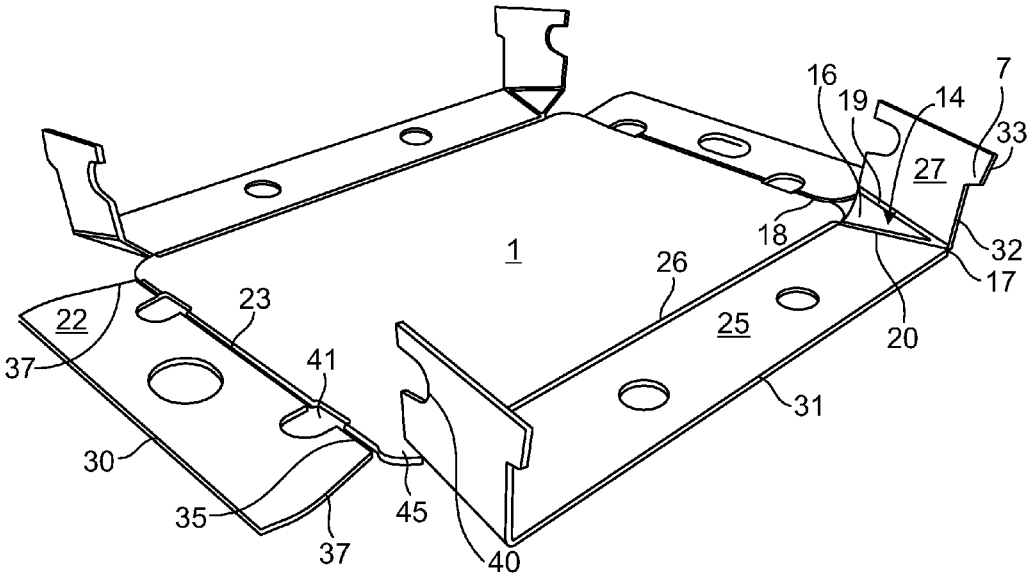
FIGS. 2 and 3 are perspective views in two successive phases of the formation of a partially reassembled tray according to the invention.

FIGS. 2 and 3 show a specific configuration at each angle 14. At each of these angled areas, the bottom wall 1 is rounded off at 15 and the two side walls that are adjacent to this interface area 16 form a triangle the apex 17 of which is located at the junction of the upper edges of the walls and the substantially rectilinear base 18 of which is opposite the rounded-off bottom part 15. The base 18 is cut from the bottom wall and joins the two opposing points from the beginning of the rounding which covers an angle of substantially 45°.

It is due to this specific shape of the angles 14 that the stacking lugs 7 fit into the rectangular outline of the initial blank 1 from which the side walls 2 to 4 are obtained through folding.

According to the figures, each of the shorter side walls 3, 5 is formed by a flap 22 that is hingedly connected to the bottom wall 1 along a fold line 23 and has a length that is slightly less than the length of the bottom wall 1.

The two longer walls 2, 4 have a more complex structure and each comprises a main flap 25 joined to the bottom wall 1 by a fold line 26 and, on each side of this main flap 25, a side flap 27 disposed across from a side edge of a flap 22 from which it is separated by a specific cut line 28. Each side flap 27 is joined to the main flap by a triangular interface area which constitutes, when the walls are reassembled, the triangular area 16 of the tray and the lateral lines of which are inclined fold lines 19 and 20. At the time of assembly of the tray, the flaps 27 are adhered to the wall flaps 22 in an inherently known manner.

Figure 1:
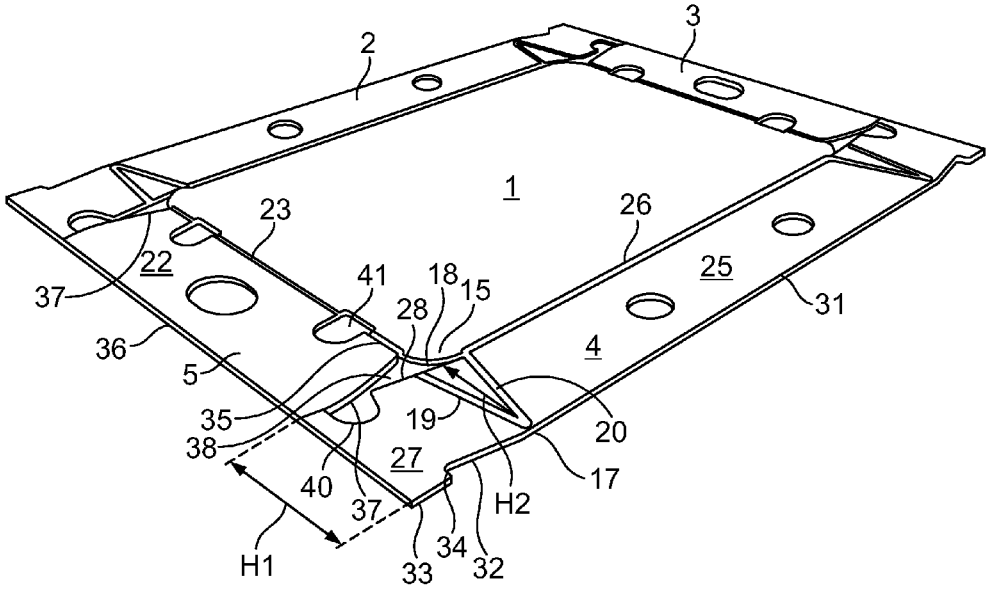
FIG. 1 is a flat perspective view of the initial blank of corrugated cardboard for a tray for transporting and displaying according to the invention.

With reference to FIG. 1, one can see, more specifically, that the cut line 28 of each side flap 27 separating it from the adjacent side edge of a flap 22 is inclined with respect to the fold line 26 of its main flap 25 so that the flap 27 has a height h1 at its free end, which is greater than the inner height h2, which is to say of the triangular part 16.

It can be seen that the outside edge 32 of a flap 27 which follows the outside edge 31 of its main flap 25 is cut so as to extend from the triangle vertex 17 in a manner substantially parallel to the cut line 28 over a predetermined length and then returns in its part 33 to the free perpendicular outer edge 30 in alignment with the outside edge 31 of the main flap 25. The edge parts 32 and 33 are therefore joined by a relatively short portion of cut line 34. As shown in FIGS. 2 and 3, the part of each flap 27 delimited by the edges 33 and 34 constitutes a stacking lug 7 of a reassembled tray.

The fold lines 19 and 20 of each area of triangular angles 16 and their angle of inclination are selected such that, at the time of the forming of the side walls, which is to say when the main flap 25 is folded around its fold line 26 and each flap 27 is folded along the lines 19 and 20, the rim or the edge 28 comes to rest on the adjacent peripheral area 35 of the bottom 1, as can be seen in FIG. 2. In this figure, it is visible that the free outside edge 32 extends parallel to and at the level of the upper edge 31 of the side wall 25 and the upper edge of the shorter adjacent side wall 3, 5 that has been reassembled by folding on the fold line 23. By contrast, the part of the flap 27 delimited by the edges 33 and 34 protrudes from the upper edge 36 of the corresponding side wall 3, 5, thus forming the stacking lug 7 without protruding beyond the rectangular outline of the initial blank.

To enable the pivoting of the flaps 27, the adjacent side edge 37 of each flap 22 is therefore cut in such a manner that an opening 38 is created in the blank around the rounding 15 of the angle area 14 of the bottom wall 1.

Regarding the cutouts 9 for receiving a stacking lug of another tray below it in a stack, it is formed by an oval cutout 40 in the edge 28 of a flap 27 and 41 in the adjacent flap 22. The cutout 41 extends to the peripheral area 35 of the bottom wall 1. The cutouts 40 and 41 are arranged such that they overlap when the walls are assembled. The positioning of the cutout 40 is such that its median line perpendicular to the edge 28 cuts substantially in the middle of the part forming the lug 7. In this way, each lug 7 is located in the assembled tray in a substantially vertical position below a lug.

The description of a tray according to the invention that was just provided with reference to the figures shows that the invention offers numerous advantages. First of all, it provides savings of corrugated cardboard to the extent that the parts of the blank that are designed to form the lugs of the tray do not extend beyond the advantageously rectangular outline of the blank. To give the lugs good mechanical strength, the grooves of the corrugated cardboard are oriented in the side walls of which the stacking lugs constitute a part in the direction of compression, which is to say substantially in the direction of the stacking of the trays. The substantially triangular configuration of the angles of the tray and the rounded shape at these places of the bottom wall is also advantageous when the stack of trays is wrapped with plastic wrapping film surrounding the stack.

The fact is also quite considerable that, despite these numerous advantages, the trays can be produced using conventional cutting, folding and adhering techniques with standard existing machines.

As will readily be understood, numerous modifications can be made to the tray that was described above for the sake of example without going beyond the scope of the invention. It is therefore possible to provide the lugs on the long sides of the tray. It is sufficient to this effect to provide the side flaps on the shorter flaps bearing the reference 3 and 5 in the drawings. By modifying the dimensions of the triangular angles of the tray, it is possible to obtain shorter or longer lugs in the direction of their extension beyond the upper edge of the tray.

The invention claimed is:

1. A tray for transporting and displaying items such as yogurt containers, comprising a bottom wall (1), first opposed side walls (2, 4) and second opposed side walls (3,5) having a single thickness which are hingedly connected to the bottom wall and folded upwards at a substantially right angle, the tray being obtained by folding from a single rectangular blank of corrugated cardboard and characterized in that the blank has a generally rectangular outline defined by cut lines designed to form upper edges (30,31) of each the first and second opposed side walls (2, 3, 4, 5) of the tray included in the rectangular outline, wherein:

each first opposed side wall (2,4) comprises a main flap (25) and a pair of side flaps (27) having a height (H1) and forming a stacking lug (7) thereon, and each side flap (27) is hingedly connected to the respective main flap (25) by an interface area (16), having a second height (H2) such that the side flap pivots in an attachment position perpendicular to the main flap, and attaches to an adjacent second side wall (3, 5), in that an inside edge (28) of the side flap is inclined with respect to a fold line (26) of the main flap such that the height (H1) of the side flap (27) is greater at the upper edge (30) than the second height (H2) in the interface area (16), and in that this interface area (16) comprises fold lines (19, 20) which ensures that the inside edge (28) is parallel to the bottom wall (1) when the side flap (27) is in the attachment position and the interface area (16) is in the shape of a triangle having an apex (17), a base (18) and lateral sides formed by the fold lines (19,20), and located between the side (27) and main (25) flaps and adjacent to the bottom wall (1).

2. A tray as set forth in claim 1, characterized in that the bottom wall (1) has four corners (45) and is cut and rounded off at each of said corners (45).

3. A tray as set forth in claim 1, characterized in that, in the blank, each of the side flap (27) have an outside edge comprising a first edge part (33) which is in alignment with the upper edge (31) of the main flap (25), and a second edge part (32), whereas the second edge part (32) is inclined and parallel to the inside edge (28) of the side flap (27), and in that, when the side flap (27) is in the raised attachment position, the second edge part (32) is substantially in alignment with the upper edge of the second opposite side walls, the first edge part (33) constituting the stacking lug (7).

4. A tray as set forth in claim 3, characterized in that each of the side flap (27) comprises a notch (40) cut in the inside edge (28) of the side flap (27), which is located below the first edge part (33) of the lug (7) and forms, with a notch (41) in the adjacent second opposite side wall (3, 5) and in a peripheral portion (35) of the bottom wall (1), when the tray is assembled, a receiving space for the lug (7) of a lower tray in a stack of trays.

* * * * *